US005513403A

United States Patent [19]

Wooten, Jr.

[11] Patent Number: 5,513,403

[45] Date of Patent: May 7, 1996

[54] FITTED SHEET

[76] Inventor: Gerald E. Wooten, Jr., 298 County Rd. 1468, Cullman, Ala. 35055

[21] Appl. No.: 356,542

[22] Filed: Dec. 15, 1994

[51] Int. Cl.[6] ..... A47G 9/04

[52] U.S. Cl. ..... 5/497; 112/418

[58] Field of Search ..... 5/497, 495; 112/413, 112/418

[56] References Cited

U.S. PATENT DOCUMENTS

| | | | |
|---|---|---|---|
| 2,164,036 | 6/1939 | Lane | 112/418 |
| 2,576,324 | 11/1951 | Wirt | 112/418 |
| 2,662,234 | 12/1953 | Citron | 5/334 |
| 3,010,114 | 11/1961 | Lipschultz | 112/418 |
| 3,148,388 | 9/1964 | Espersen | 5/334 |
| 4,192,032 | 3/1980 | Geraci | 5/497 |
| 4,662,013 | 5/1987 | Harrison | 5/497 |
| 4,703,530 | 11/1987 | Gusman | 5/497 |
| 4,768,252 | 9/1988 | Ross | 5/497 |
| 4,777,677 | 10/1988 | Dugan | 5/497 |
| 4,937,904 | 7/1990 | Ross | 5/497 |
| 5,003,902 | 4/1991 | Benstock et al. | 112/418 |
| 5,287,574 | 2/1994 | Kardell et al. | 5/497 |

FOREIGN PATENT DOCUMENTS

| | | | |
|---|---|---|---|
| 0425466A1 | 2/1991 | European Pat. Off. | A47G 9/02 |
| 108979 | 8/1960 | Germany | 112/418 |

*Primary Examiner*—Michael J. Milano
*Attorney, Agent, or Firm*—Watson Cole Stevens Davis

[57] ABSTRACT

A fitted sheet is designed to have a deep pocket to accommodate deeper mattresses, although the sheet may be used with mattresses of different size. An elastic binding is disposed around the lower edge of the sheet and extends along the entire length thereof. The binding is secured in place by stitching which extends through the binding and the lower edge portions of the sheet. An elastic band is disposed diagonally across each of the corners of the sheet. Each end of each of the bands is secured to the sheet by the stitching which secures the binding in place, and in addition, supplementary securing stitching in the form of a bar tack is provided for securing each end of each of the bands to the sheet to ensure that the ends of the bands do not pull away from the sheet.

1 Claim, 2 Drawing Sheets

FITTED SHEET

BACKGROUND OF THE INVENTION

The present invention relates to fitted sheets for mattresses, and more particularly to a fitted sheet having diagonally extending elastic bands at the corners thereof for holding the sheet in place relative to the corners of the mattress.

Fitted sheets for mattresses are well-known. Such sheets employ an elastic binding at the lower edge of the sheets, and some of these sheets also include diagonally extending elastic bands at the corners thereof. The construction of such sheets is designed to fit mattresses of different size and to eliminate wrinkles in the sheet. A problem arises when prior art fitted sheets are grasped to lift up the underlying mattress since the sheets tend to slip off of the mattress, which is undesirable. Significant forces may be applied to the diagonal bands at the corners of such sheets, and the bands may pull away from the sheets at the point of attachment thereto, particularly since these elastic bands are quite strong and are not usually subject to tearing at an intermediate point thereof.

Accordingly, an important consideration in the construction of such fitted sheets is to provide an economical and strong manner of attaching the corner elastic bands thereof to the lower edge portions of the sheet which will ensure that the durability of the bands in use is based on the strength of the bands themselves and not on the strength of the interconnection between the bands and the sheet.

SUMMARY OF THE INVENTION

The present invention includes a fabric body defining a plurality of vertical corners and a continuous lower edge. The sheet is designed to have a deep pocket to accommodate deeper mattresses, although the sheet may be used with mattresses of different size. An elastic binding is disposed around the lower edge of the sheet and extends along the entire length thereof. The binding is secured in place by stitching which extends through the binding and the lower edge portions of the sheet. An elastic band is disposed diagonally across each of the corners of the sheet. Each end of each of the bands is secured to the sheet by the stitching which secures the binding in place, and in addition, supplementary securing means is provided for securing each end of each of the bands to the sheet to ensure that the ends of the bands do not pull away from the sheet.

The supplementary securing means comprises a bar tack, and the ends of the bands are folded over and disposed against the inwardly facing surface of the binding such that each bar tack extends through a lower edge portion of the sheet, through two layers of binding and through two layers of the associated band. This construction is inexpensive to manufacture, yet provides a very strong and reliable interconnection between the ends of the bands and the sheet.

The arrangement of the present invention provides a snug fit under any mattress and affords a neat, tight look with smooth corners when in operative position. The sheet may be easily put on a mattress, but will not accidentally pop off even when raising one end of a heavy mattress weighing up to two-hundred pounds by lifting two corners of the sheet. A corner of the sheet will not come off unless the associated diagonal strap is pulled out first.

DESCRIPTION OF THE PREFERRED EMBODIMENT

Figure 1:
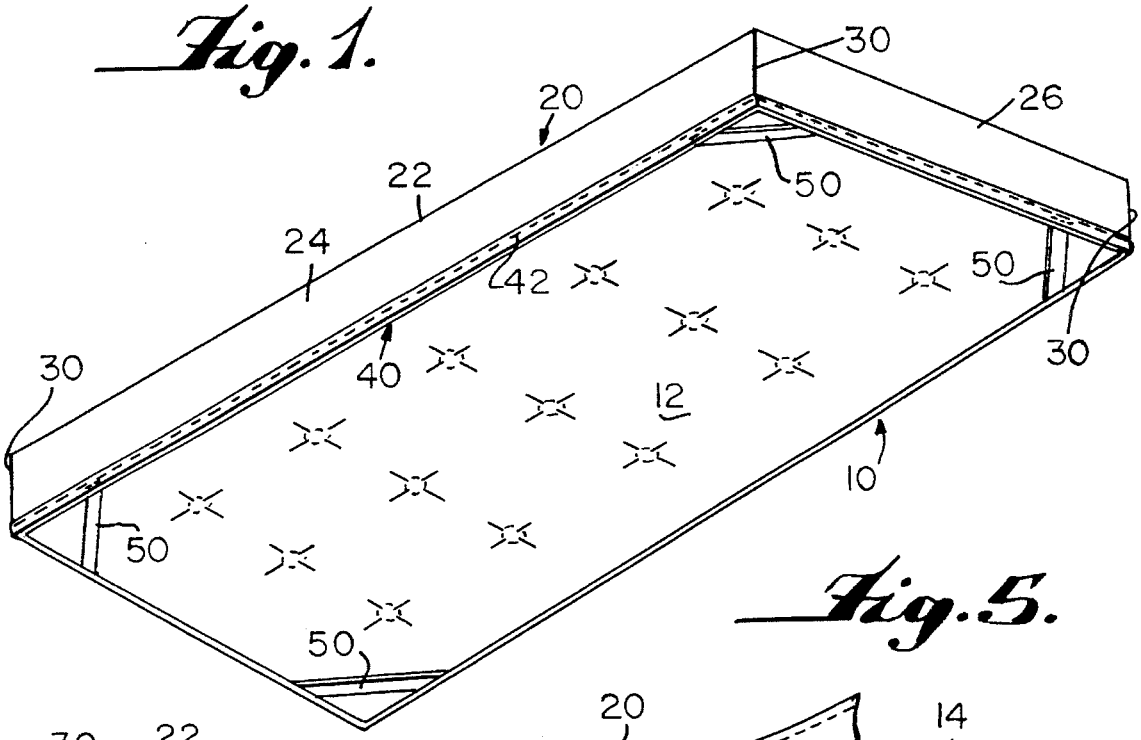
FIG. 1 is a bottom perspective view of a mattress with a fitted sheet of the invention mounted thereon.
Figure 5:
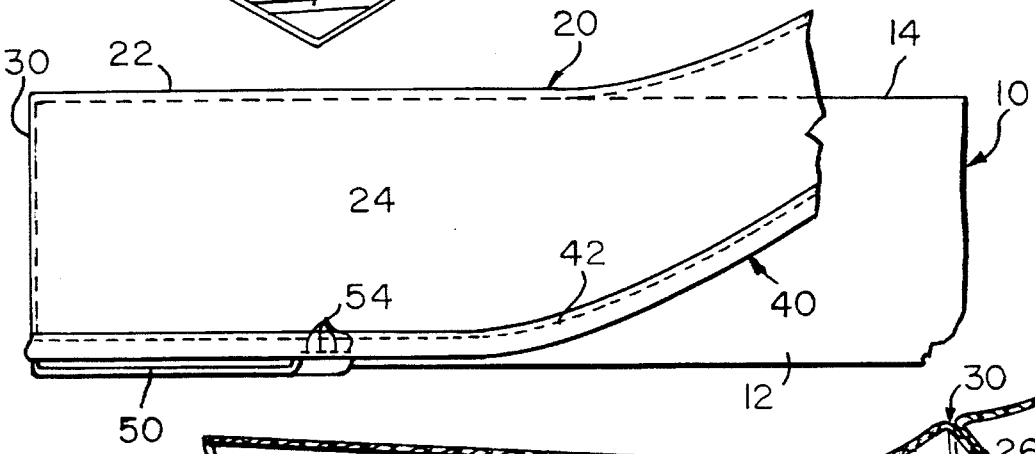
FIG. 5 is a view showing the manner in which a corner of the sheet is mounted on a mattress.
Figure 2:
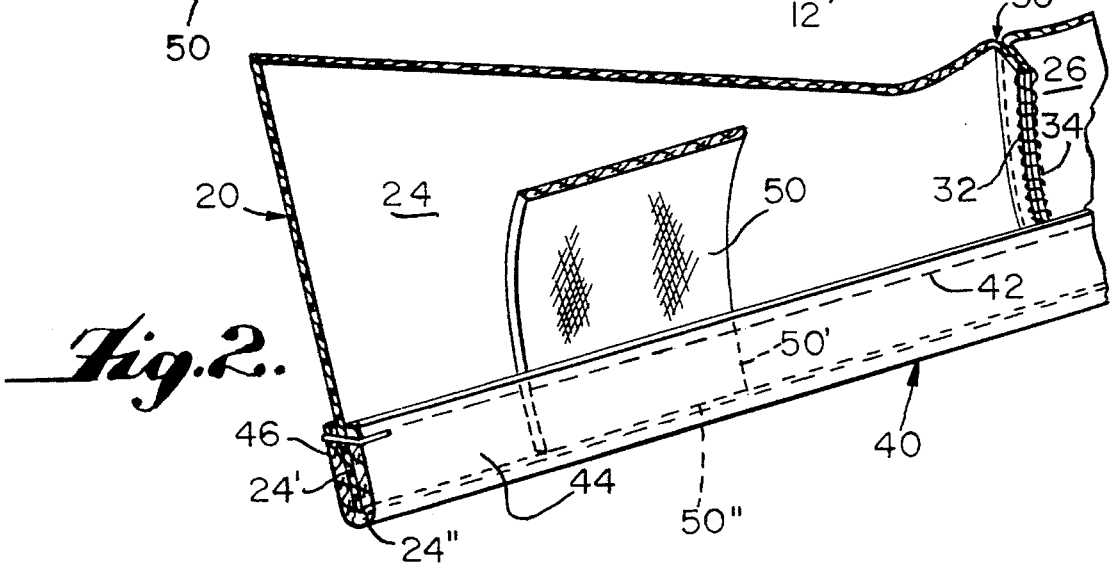
FIG. 2 is an enlarged perspective section through the lower part of a corner of the sheet showing the manner in which the end of an elastic band is initially inserted and secured in place.
Figure 3:
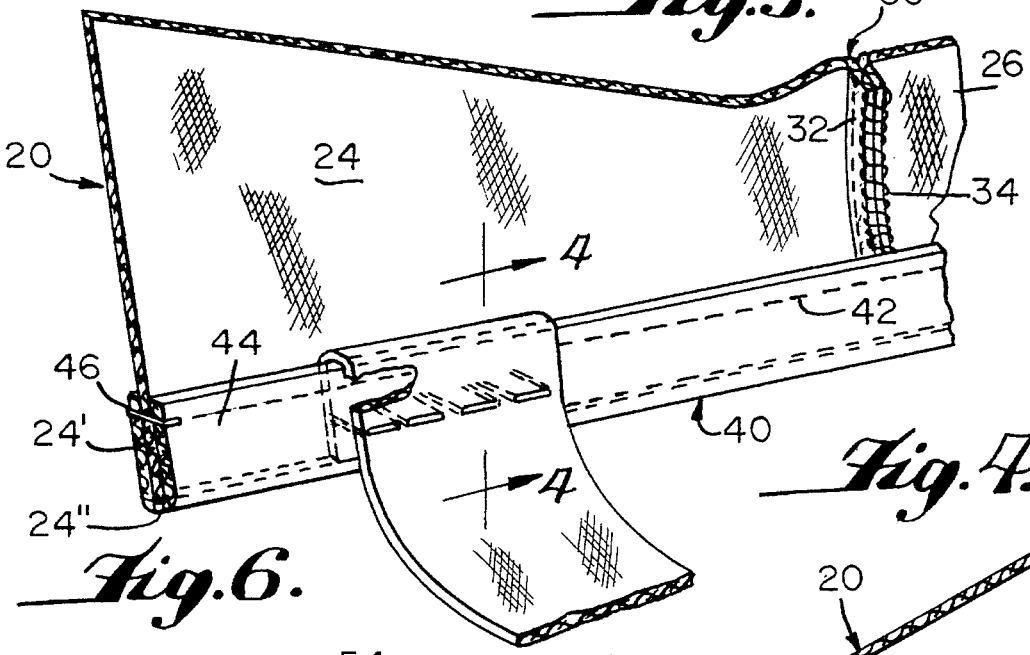
FIG. 3 is a view similar to FIG. 2 showing how the end of an elastic band is folded over and disposed against the inwardly facing surface of the binding and secured thereto by a bar tack.

Referring to the drawings wherein like reference characters designate corresponding parts throughout the several views, the invention is shown as being mounted on a conventional rectangular mattress 10 having a bottom face 12 and an opposite upper face 14. The fitted sheet comprises a body 20 formed of any suitable fabric such as cotton, a cotton blend or satin and the like. Body 20 includes a top portion 22, opposite side portions 24 and opposite end portions 26. Adjacent side and end portions are seamed together in the usual manner at four seams to form four vertical corners 30. As seen in FIGS. 2 and 3, each seam defining a vertical corner includes a straight line of stitching 32 and a conventional overlock or safety stitch 34.

The side and end portions of body 20 have lower edge portions which terminate in lower edges. As seen in FIGS. 2 and 3, each side portion 24 has a lower portion 24' which terminate in a lower edge 24". Each end portion has a similar lower portion and lower edge. The lower edges of the side and end portions extend lengthwise of the respective portions and are spaced from the top portion 22 of body 20. The lower edges of the side portions join with the lower edges of the end portions to form a continuous lower edge of the sheet.

An elastic binding 40 is formed of conventional material used for such elastic binding material in fitted sheets and is disposed around the continous lower edge of the sheet and extends along the entire length of the lower edge of the sheet. The binding is secured to the lower edge portions of the sheet by a line of stitching 42. The binding includes an inwardly facing surface 44 and an outwardly facing surface 46.

Four similar elastic bands 50 are provided, each of these bands being formed of the same material as the binding and extending diagonally across one of the corners of the sheet. Each band has one end thereof secured to one of the side portions of the sheet and the opposite end thereof secured to an adjacent end portion of the sheet. The opposite ends of each band are each spaced from the associated corner and are secured in place in a similar manner.

Referring to FIG. 2, an initial step in securing an end of a band 50 to a side portion of the sheet is illustrated. The end 50' of band 50 is initially sandwiched between the inwardly facing surface of side portion 24 and the binding 40 and is secured in place by the line of stitching 42. It will be noted that the band terminates in an end edge 50" which is disposed adjacent to the lower edge 24" of side portion 24.

Figure 4:
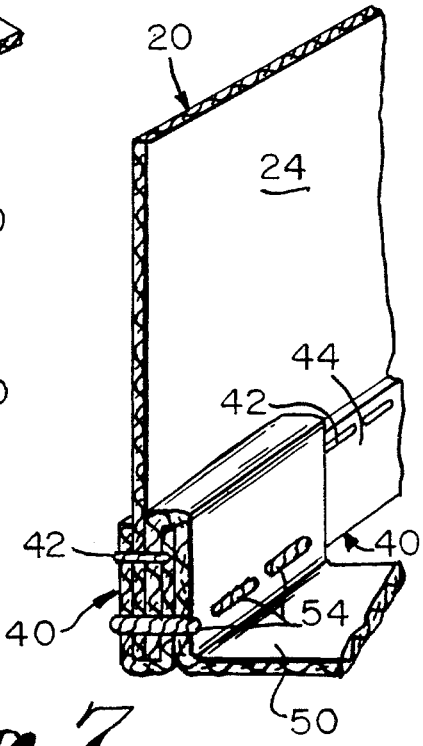
FIG. 4 is an enlarged sectional view taken along line 4—4 of FIG. 3.
Figure 6:
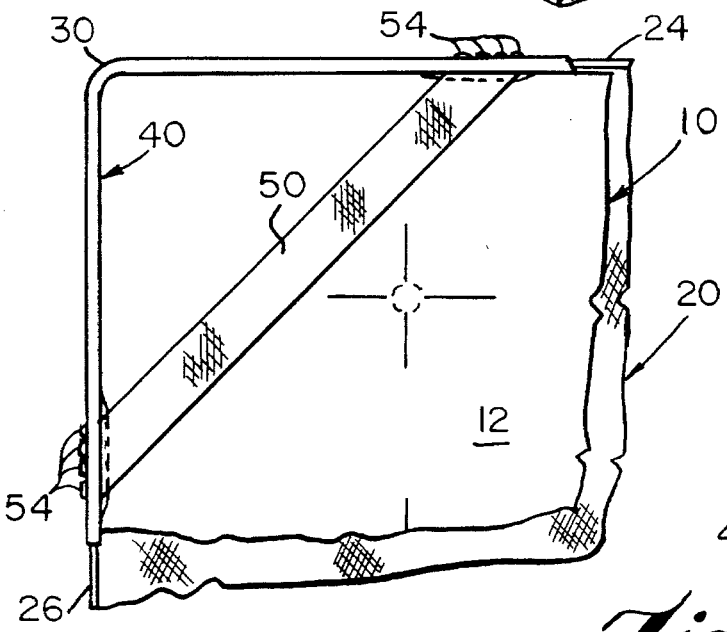
FIG. 6 is a bottom view of one of the corners of the sheet when mounted on a mattress.
Figure 7:
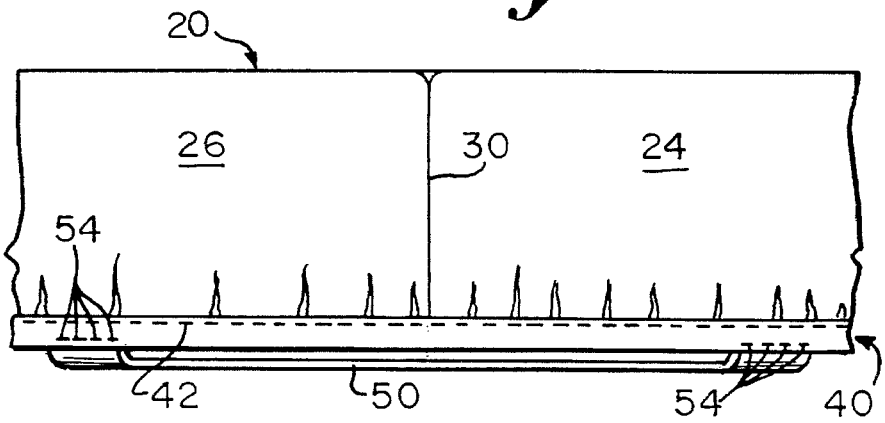
FIG. 7 is an elevation showing one of the corners of the sheet when mounted on a mattress.

In order to ensure that the end of band 50 will not pull away from the sheet, a supplementary securing means is provided. Referring to FIG. 3, the next step in securing the end of the band to the sheet is illustrated. The band is folded over the upper edge of binding 40 and is positioned against the inwardly facing surface 44 of the binding. A bar tack 54 comprising the supplementary securing means is then formed by a conventional bar tack machine so that as seen in FIG. 4, the bar tack extends through the associated lower edge portion of side portion 24, through two layers of binding lying on opposite sides of the lower edge portion of side portion 24, and through two layers of band 50 lying on opposite sides of the inner part of the binding. It is understood that each end of each of the bands 50 is secured to the associated lower portion of the sheet with a construction as shown in FIG. 4. With this construction, the elastic band 50 will separate at an intermediate point and be destroyed before the ends of the band will tear away from the sheet.

The invention has been described with reference to a preferred embodiment. Obviously, various modifications, alterations and other embodiments will occur to others upon reading and understanding this specification. It is our intention to include all such modifications, alterations and alternate embodiments insofar as they come within the scope of the appended claims or the equivalent thereof.

What is claimed is:

1. A fitted sheet for a mattress comprising, a fabric body having a top portion, side portions and end portions, adjacent side and end portions being seamed together to form a plurality of vertical corners, said side and end portions having lower edge portions terminating in lower edges extending lengthwise thereof and spaced from said top portion, said lower edges joining one another to form a continuous lower edge of the sheet, an elastic binding disposed around said lower edge and extending along the entire length of said lower edge of the sheet, said elastic binding having a pair of upper edges, said binding being secured to said lower edge portions by stitching, an elastic band disposed at each corner of the sheet, each band extending diagonally across the associated corner and having opposite ends secured to one of said side portions and an adjacent end portions respectively at points spaced from the associated corner, each end of each of said bands being secured in place by said stitching and by supplementary securing means to ensure that the ends of the bands do not pull away from the sheet, each end of each of said bands being sandwiched between one of said lower edge portions and said binding and terminating in an end edge which is disposed adjacent said lower edge of the sheet, said binding including an inwardly facing surface and an outwardly facing surface, each end of each of said bands being folded over one of said upper edges of the binding and disposed against said inwardly facing surface of the binding, said supplementary securing means for each end of each of said bands comprising a bar tack extending through an associated lower edge portion, through two layers of said binding and through two layers of the associated band.

* * * * *